United States Patent [19]

Melin

[11] Patent Number: 4,576,713

[45] Date of Patent: Mar. 18, 1986

[54] FEED STREAM SPLITTER FOR MULTIPLE DECK SCREENING MACHINE

[75] Inventor: Gerald W. Melin, Stanchfield, Minn.

[73] Assignee: Carter-Day Company, Minneapolis, Minn.

[21] Appl. No.: 632,427

[22] Filed: Jul. 19, 1984

[51] Int. Cl.[4] ..... B07B 1/00; B07B 1/28

[52] U.S. Cl. ..... 209/254; 209/316; 209/317; 209/356; 137/561 A; 198/569

[58] Field of Search ..... 209/315, 254, 316, 317, 209/318, 319, 263, 264, 265, 266, 353, 355, 357, 356; 193/14, 23; 406/181; 198/569, 771

[56] References Cited

U.S. PATENT DOCUMENTS

| | | | |
|---|---|---|---|
| 1,052,946 | 2/1913 | Otis | 209/353 X |
| 2,908,391 | 9/1959 | Frevert | 209/315 |
| 3,819,050 | 6/1974 | Lower et al. . | |
| 4,069,146 | 1/1978 | Lower et al. . | |
| 4,234,416 | 11/1980 | Lower et al. | 209/247 |
| 4,322,288 | 3/1982 | Schmidt | 209/316 |

*Primary Examiner*—Frank W. Lutter
*Assistant Examiner*—Thomas M. Lithgow
*Attorney, Agent, or Firm*—Schroeder & Siegfried

[57] ABSTRACT

A multiple deck screening machine wherein the feed material is divided into separate equal fractions on a rubble screen deck and scalp screen decks. Each deck includes downwardly slanting distribution panels having serrated lower edges. Particulate flow over the serrated edges is divided into separate fractions. Each adjacent fraction passes into a different parallel vertical channel which serves a particular screen deck via a chute. The chutes and channels extend the full width of the screens. Flow across the serrated edges is separated due to the notches and tongues and upstanding dividers along the common edge to each notch and tongues. Each notch and tooth of the rubble screen deck is disposed in juxtaposition to an opposed tongues and notch respectively so that excess flow over a tongues may pass over its channel into the channel of the opposed notch. The rubble screen deck including a pair of downwardly and inwardly inclined distribution panels which oppose each other and define a flow gap therebetween. Each of the rubble screen deck distribution panels also having serrated lower edges and coacting so as to send an equal fraction of particulate flow to each of four lower scalp screen decks.

1 Claim, 4 Drawing Figures

FEED STREAM SPLITTER FOR MULTIPLE DECK SCREENING MACHINE

DESCRIPTION

1. Field of the Invention

This invention relates to screening machines of the type wherein the material to be screened is divided or split into separate fractions which are then directed to several screens in parallel inclined flow paths. More particularly, it relates to a structure for splitting the feed stream into separate fractions and for spreading the fractions evenly onto the respective screens.

2. Background of the Invention

Particulate material often requires screening to remove waste debris and to collect uniformly sized particulate material. In the grain industry, screeners handle grain throughput as large as 40,000 bushels per hour or even more. Higher rates have generally required larger screen areas. In order to handle a high flow rate while minimizing the floor area of the machine, it has been the practice for many years to provide the needed area among a plurality of screens or "decks" arranged one above the another as a stack, and to divide the material to be screened into several fractions for separate screening on the respective screens. After the fines in each fraction have been separated on their respective screens, the product fractions are recombined.

In order to most effectively utilize each screen of such a stack or "bank", it is important to divide the input stream into essentially equal fractions of uniform flow rate, to feed the respective screens equally so that no screen is underfed and none is overfed. At the same time, it is important that the fractions be fed onto the respective screens in a manner which rapidly distributes the material evenly over the entire screen area, so that all of the area will be used at an effective rate.

This invention is aimed at providing a stream splitter or distributor for a multiple deck screener which will more accurately divide the feed stream into separate substantially equal fractions and distribute those fractions onto the respective screens in a manner to use the area of each screen more effectively at any flow rate.

Lower et al, U.S. Pat. No. 4,234,416 shows a multiple deck screening machine which initially divides the screen into parts on a scalping screen. The throughput from the scalping screen falls into parallel vertical channels each of which serves a particular screen deck via a chute. Each channel is of a relatively narrow width as compared to the width of the screens. The lower chutes include widened portions that extend laterally from their respective channels into areas which are masked or closed above by overlying upper chutes. The effort is to provide flow areas which are wider than their channels to thereby provide better flow distribution unto the screens.

In devices such as shown in Lower et al the screening motion is of a gyratory type which involves a circular or orbital screen motion in a horizontal plane. The grain is deflected off the sides of the narrow chutes in Lower et al such that the fractions which are received by some chutes do not correspond to their width and the feed is unevenly fractionated. The device of Lower et al attempts to elminate this disadvantage by widening portions of the lower chutes.

In many prior screeners, the width of each chute has been relatively small in relation to the width of the screen. The chutes for each deck have had a total width, in proportion to the screen width, equal to the reciprocal of the number of decks. That is, the chutes feeding one screen of a five screen deck machine total 1/5 the width of the screen, so as to intercept that fraction of the grain. The narrow width of the chute in relation to the screen which it feeds has led to poor distribution because the mass of material enters the screen through the relatively narrow "window" that is defined by the chute width. This tends to overload the screen adjacent the chute discharge area, and to underchange or starve the adjacent areas at the upstream end of the screen, on either side of the chute.

This invention is further aimed at feeding each screen more uniformly by providing full width channels and rubble and scalping decks having longitudinal dividers to more evenly distribute the volume of flow.

BRIEF SUMMARY OF THE INVENTION

In the screener of this invention, the particulate material to be screened passes through a first rubble screen in a rubble deck. Smaller diameter particles pass through the rubble screen onto a pair of slanting distribution panels whose lower edges are separated by a divider gap. Each lower edge of the distribution panels include a plurality of longitudinal dividers. The lower edge is notched between every other longitudinal divider such that half of the particles from each distribution panel passes through the divider gap and the other half passes through the notches onto opposed upper scalping screen decks. Each upper scalping screen deck thereby receives about one-quarter of the original particles minus the rubble.

In the event of overflow conditions, the excess particles bridge the divider gap and are received by the opposed notches of the other rubble screen deck distribution panel. Likewise, excess flow may pass over the notches and enter the divider gap, thereby equalizing flow on the lower decks.

The material passing through the divider gap from the slanting distribution panels falls onto a peaked flow splitter where it is divided onto the lower scalping screen decks. Each scalping screen deck slants away from the apex of its respective opposing scalp screen deck. The larger material collects along the lower edges of the scalp screens in a scalp trough and is discharged.

Each scalp screen deck includes a downwardly slanting distribution panel which includes longitudinal dividers and alternating notching between the dividers at their lower edges. Preferably, the longitudinal dividers extend ahead of the notches so as to prevent more than half the particulate from entering the notches. The falling curtain of particles from each scalp deck distribution panel is divided in half as it falls. A series of vertical dividers are positioned in the path of the falling particulate material, each divider defining channels between the other. Each channel extends the full width of the lower screens. Each channel includes a chute that is the full width of the screen and which supplies particulate to its respective screening deck. Each individual screening deck separates out the fines from the desired material which has been collected in a single particulate outlet. The feed falling from each channel from its respective scalp deck distribution panel is discharged onto its screen across the full screen width. Since only half of the material from each scalp deck distribution panel passes to a column, the feed onto a lower screen is able to fan out creating a more uniform distribution.

BRIEF DESCRIPTION OF THE DRAWINGS

A detailed description of one preferred embodiment of the invention is hereafter described with specific references being made to the drawings in which.

DETAILED DESCRIPTION OF THE DRAWINGS

Figure 1:
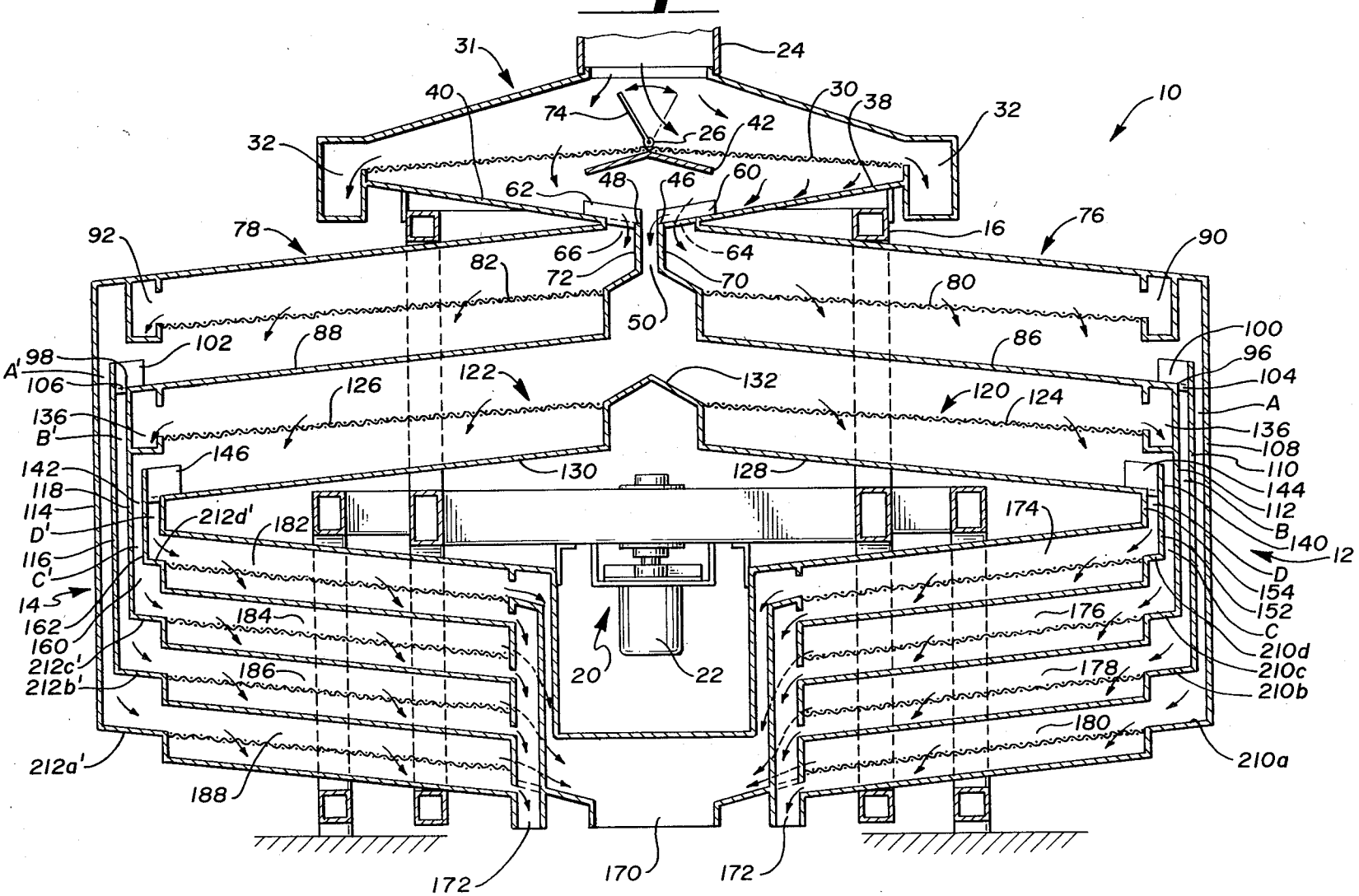
FIG. 1 is a side view of the machine in cross section.
Figure 2:
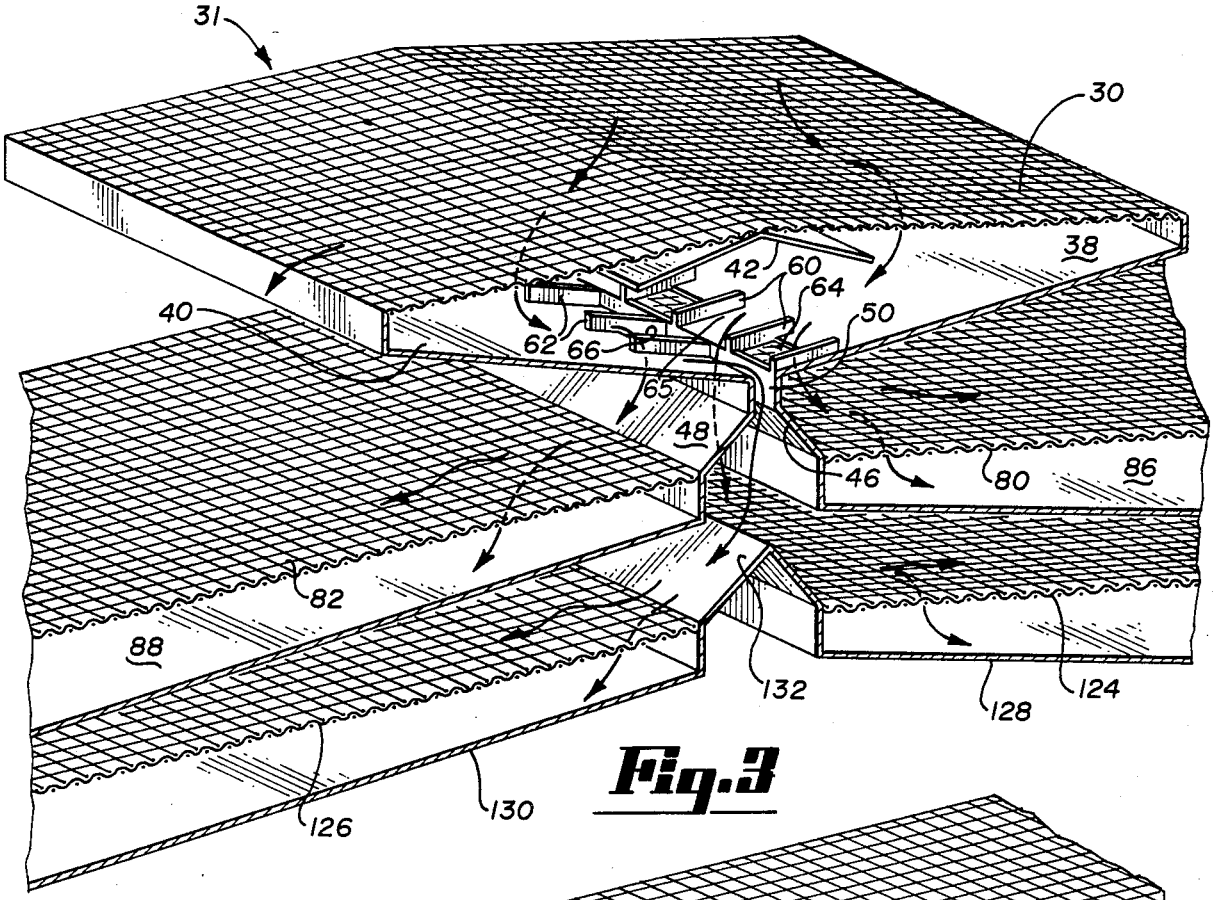
FIG. 2 is a diagrammatic perspective view showing a portion of the machine of FIG. 1 broken away to show the rubble decks and scalping decks distribution.
Figure 3:
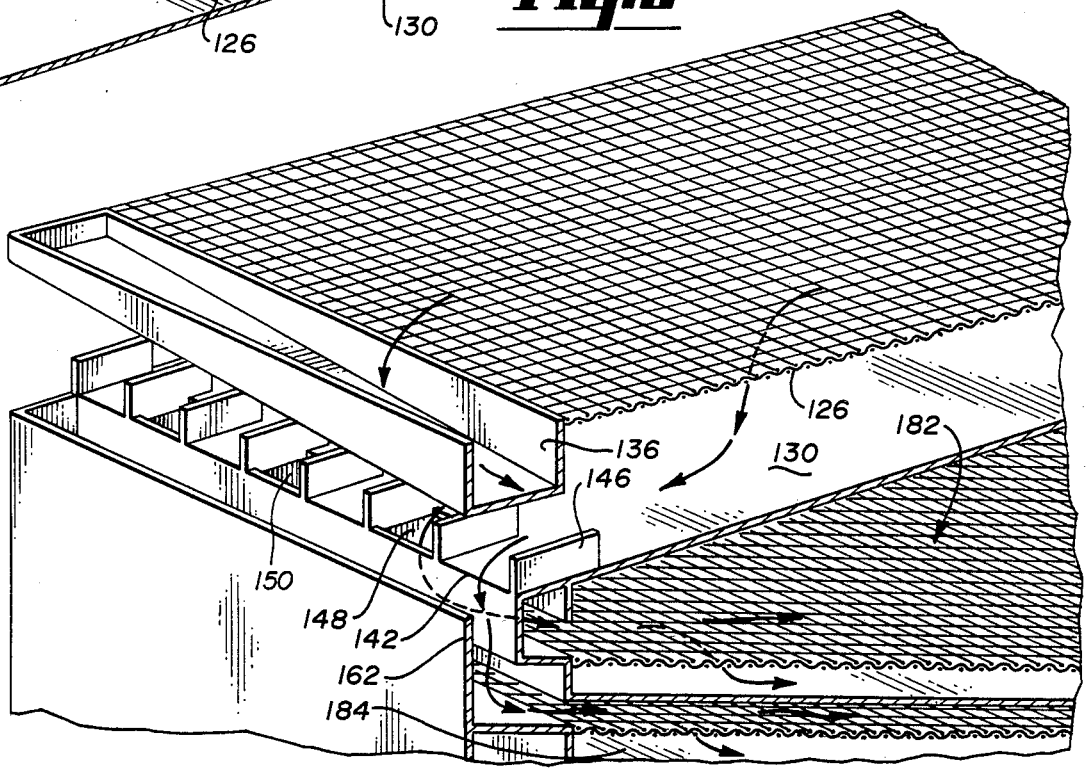
FIG. 3 is a diagrammatic perspective showing a portion of the machine of FIG. 1 broken away to show a scalp screen deck lower edge and the distribution of feed through its two channels to the screening decks.

The screening machine designated generally at 10 in the drawings includes two banks of screens designated at 12 and 14 respectively which are mounted in a unitary, generally rectangular frame 16.

Screener 10 is driven in a gyratory screening movement by a central eccentric drive 20 driven by a motor 22. The drive mechanism is conventional and is mounted to frame 16. A gyratory type of motion is especially desirable for high rate machines because the horizontal motion rapidly distributes the grain over the entire width of the screens with little vertical vibration or hop so that there is little churning or remixing of fines. This quickly achieves stratification of fines and promotes fast passage through the screen openings.

In machine 10, the two banks of screens are arranged such that the banks are opposed to one another. Opposed banks 12 and 14 present screens which are angulated downwardly toward the center.

The incoming material descends from chute 24 onto a central apex or ridge 26 over the two banks, which in effect splits the feed into two separate streams to the two banks. The flow to each bank from apex or ridge 26 is first onto a downwardly and outwardly sloping rubble screen 30. This screen (which is optional) removes large particles, preferably in the vicinity of $1\frac{1}{2}$ to 2 inches in diameter. The large material remains on screen 30 and drops into an overs trough 32 which is slanted in a direction to chute the overs to a takeoff chute (not shown) from whence it is discharged.

The balance of the feed, including the product, fines and scalp falls through rubble screen 30 onto downwardly and inwardly slanting distribution panels 38 and 40. A peaked diverter plate 42 situated directly below ridge 26 of screen 30 and above the distribution panels insures that the feed falls onto the distribution panels 38 and 40. After falling onto the distribution panels, the feed fans out (under the influence of the screening motion) across the entire width of the panel to their lower edges 46, 48 which do not meet and define a divider gap 50.

The plurality of longitudinal dividers 60 and 62 extend from lower edges 46 and 48 on the upper surface of the panels. Each of the lower edges 46, 48 includes notches or cutouts 64 and 66 which define tongues 65 therebetween. Preferably, longitudinal dividers 60 and 62 extend upstream of the open areas provided by notches 64 and 66 as shown. Since particles seek a path of least resistance, greater than half the particles would tend to enter notches 64 and 66 if dividers 60 and 62 only extended the length of the notches. Longer dividers 60, 62 ensures a more equal distribution of particles over lower edges 46 and 48. A pair of vertical walls 70, 72 extend downwardly from lower edges 46, 48 respectively. Feed passing from a lower edge of the distribution panel is thus split into two equal segments, one of which passes through the cutouts and the other of which passes through a divider gap 50. The two segments are separated by the vertical walls. In period of excess flow, particles will flow across gap 50 and enter cutouts 64 and 66. The excess flow is thereby split more evenly to equalize flow on the lower decks.

The rubble screen deck 31 may include a flow splitter vane 74 which is hingedly mounted along ridge 26 to the diverter plate 42. The flow splitter vane 74 is adjustable to compensate for offset feed. Feed passing through cutout 64 and 66 falls onto upper scalping screen decks 76 and 78 which each include a scalping screen 80, 82 respectively and a downwardly and outwardly slanting distribution panel 86, 88, respectively. Scalping screens separate out medium sized waste in the vicinity of $\frac{1}{2}$ inch in diameter. Scalp is discharged through inclined scalp troughs 90, 92 which are slanted in a direction to chute the scalp to a takeoff chute at the lower end of the trough.

The product and the fines which are to be separated from it, falls through the scalping screens under the distribution panels over which it fans out across the entire width of the panel to a lower edge 96, 98 which lies above the outboard ends of the screens of the respective bank 12 and 14. Lower edges 96 and 98 include longitudinal dividers 100, 102 and cutouts 104, 106 which are constructed and arranged as detailed above in the rubble deck. Again, the longitudinal dividers 100, 102 preferably extend upstream from the cutouts to provide more even splitting.

The curtain of falling particulate material is divided and confined in parallel but separate streams by a series of vertically oriented flow dividers. The dividers are of sheet metal and define distribution chambers. As shown in FIG. 1, dividers 108, 110 and 112 define channels A and B, which channels extend the full width of distribution panel 86. Material passing through cutouts 104 enters channel B whereas material passing over lower edge 96 enters channel A. Distribution panel 88 includes similarly constructed dividers 114, 116 and 118 as shown in FIG. 1 which defines channels A′ and B′.

A pair of lower scalping screen decks 120 and 122 are positioned above the upper scalping screen decks as shown in the Figures. The lower scalping decks include scalping screens 124 and 126 and lower, downwardly and outwardly slanting distribution panels 128 and 130, respectively. Scalp, fines and products falls through divider gap 50 onto a peaked lower diverter plate 132, as shown, which splits the material to the right and left lower scalping screen decks. Scalp descends to scalping troughs 136 and 138 from whence it descends to take-off chutes.

The product and fines which pass through the lower scalping screens 124 and 126 fan out under the influence of the screening motion across the entire width of distribution panels 128 and 130 towards their lower edges 140 and 142 respectively. The distribution panels include longitudinal dividers 144 and 146 which are constructed and arranged as described above in the upper scalping screen deck. The lower edges include cutouts or notches 148 and 150 as described above.

The curtain of falling particulate material from lower distribution panels 128 and 130 is divided and confined in parallel but separate streams by a series of vertically oriented flow dividers. Dividers 152 and 154 in combination with divider 112 define channels C and D which extend along the full width of the distribution panel. Dividers 160 and 162 in combination with divider 116 define channels C' and D' which also extend the full width of distribution panel 130.

Each channel A–D and A'–D' leads downwardly to its own chute which directs the particulate material from the channel unto the screen decks. In each bank of screens 12 and 14, screens lie parallel to one another and slope downwardly and inwardly toward the region between banks 12 and 14, where over-the-screen product material is delivered into a product chute 170 and through-the-screens fines are delivered from a bottom pan directly into a fines chute 172.

Each bank of screens includes four screens in the form of "decks". The right bank of screens 12 includes screen decks 174, 176, 178 and 180. The left screen bank 14 includes screen decks 182, 184, 186 and 188.

The material to be screened flows in parallel over these screens from the outboard ends to the inboard ends. The screens in the bank lie parallel to one another and slope downwardly and inwardly as shown.

Figure 4:
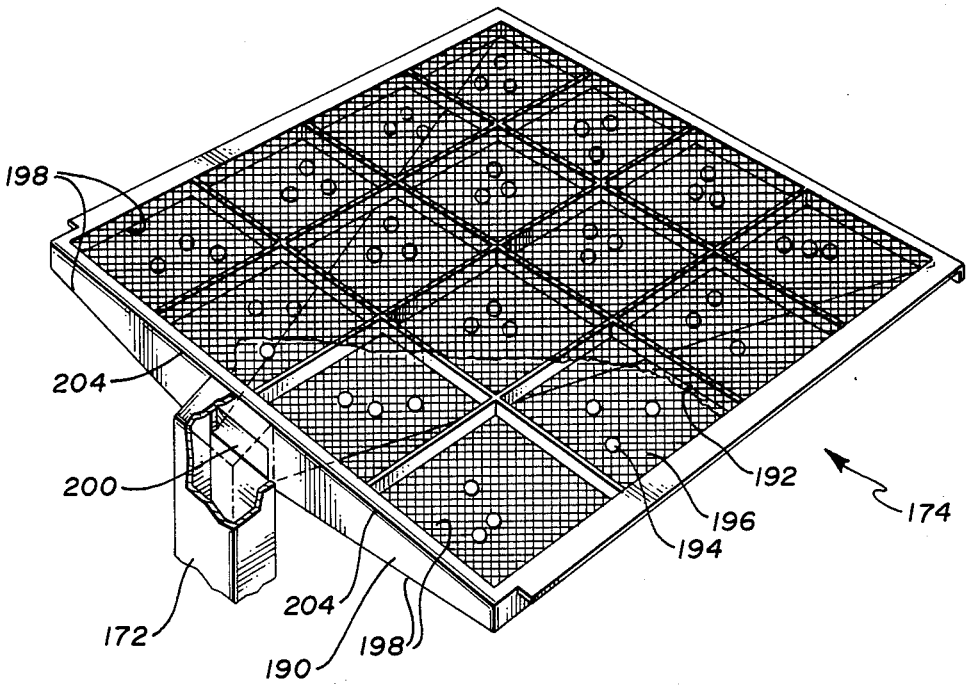
FIG. 4 is a perspective view of a single screen deck.

Each screen deck receives particulate material from its associated channel. Each screen deck includes a housing 190, as shown in FIG. 4, having a generally rectangular outline which mounts a screen 192 at the top. A ball type screen cleaner designated generally at 194 is optionally provided below the screen to aid in preventing clogging. The fines which pass through a screen 192 fall through the ball cleaner and the lower ball supporting screen 196 and are collected on a bottom pan 198. The bottom pan 198 is shaped to funnel fines toward the center of the inner edge thereof, to a fines outlet. The fines outlet enters fines chute 172 through an opening 200 as shown. The over-the-screen or product material is discharged over the inner edge 204 of the screen deck into product chute 170, on either side of fines chute 172. Each of the screens in the bank may be similar thereby presenting a very large total screen area over a relatively small floor space. Each channel A–D and A'–D' leads downwardly to its respective chute 210*a–d* and 212*a'–d'*, which directs the particulate material from the channel onto the screen. Each chute slants inwardly and passes onto the screen which that particular channel serves across its full width. Thus channel A leads downwardly to chute 210*a* onto screen deck 180. The particulate falling through each channel falls to its respective screen onto which it is directed by its chute which runs across the entire width of the distributor.

Each channel and chute is open across the full width of its respective screen deck which provides a larger window for flow from an underlying chute. This enables material falling from the channels to flow laterally or "fan out" over a wider distance than otherwise, and thus is discharged upon the screens through a wider window. The full width of the chutes and channels enables lateral flowout to take place before the material is discharged through the windows onto the screens and thus discharges onto a wider screen area. The dead space created by the pattern of cutouts or notches along the edges of the distribution panels provides a larger window for flow.

It has been found that this lateral flow arrangement provides a substantially higher flow capacity since each full width channel receives particulate from only half the width of its respective distribution panel. The capacity would otherwise be reduced, and the machine would screen less effectively at high flow rates because the material would be discharged less uniformly onto the screens.

The novel serrated edges of each distribution panel of the invention divides the particulate flow into separate equal fractions. The alternating tongues 65 and open areas provided by the notches and cutouts 64 and 66 allows the particulate to begin spreading out laterally in the full width channels as soon as it begins falling. Flow capacity is thereby substantially increased.

In operation, grain or other particulate enters chute 24 and is split by flow splitter 74 onto the rubble screen to the right and left. Rubble-free particulate falls onto distribution panels 38 and 40 and is divided again as it passes over the notches and teeth of the serrated edges. Each fraction is directed onto a separate scalp deck. The scalp-free particulate falls over the distribution panel's serrated edges and enters the full width channels. Each channel directs its fraction onto a separate screening deck which removes the fines from the desired particles. The initial flow is thereby evenly split into eight fractions which reduces the floor space required for the machine while increasing the machine's capacity.

In considering this invention, it should be remembered that the present disclosure is illustrative only and the scope of the invention should be determined by the appended claims.

What is claimed is:

1. In a multiple deck screening machine;

(a) a pair of opposed uninterrupted distribution panels mounted in opposed inclined and slightly spaced relation, said panels being mounted for agitated movement to facilitate the movement of particulate material downwardly across their upper surfaces;

(b) said panels being inclined downwardly toward each other and each having opposed and spaced forward lowermost terminal edges located in juxtaposition so that of the other and terminating adjacent the other and defining a divider gap therebetween;

(c) each of said lowermost terminal edges being defined by a plurality of transversely space tongues extending forwardly from the lowermost portions of its panel toward its opposed distribution panel and by an open area between each adjacent pair of its said tongues;

(d) each of said tongues of each of said panels being constructed and arranged to be located opposite one of the open areas of the opposite panel and to deliver particulate material into said divider gap and to deliver particulate material into the opposite open area of the opposite panel if and when said divider gap is filled;

(e) upstanding divider plates extending along opposite sides of each of said tongues on each of said distribution panels from a point located rearwardly thereof and directing defined portions of the particulate material moving down each panel to each of said panel's respective tongues and open areas therebetween; and (f) means for maintaining the material directed by said divider plates into said divider gap and said open areas in separated relation.

* * * * *

UNITED STATES PATENT AND TRADEMARK OFFICE

CERTIFICATE OF CORRECTION

PATENT NO. : 4,576,713

DATED : March 18, 1986

INVENTOR(S) : Gerald W. Melin

It is certified that error appears in the above-identified patent and that said Letters Patent are hereby corrected as shown below:

IN THE ABSTRACT:

line 13 change "tooth" to --tongue--.

IN THE CLAIMS:

column 6, Claim 1 (b) line 4, change "so" to --to--.

Signed and Sealed this

*Sixteenth* Day of *September 1986*

[SEAL]

*Attest:*

DONALD J. QUIGG

*Attesting Officer*

*Commissioner of Patents and Trademarks*